US006293442B1

(12) United States Patent
Mollayan

(10) Patent No.: US 6,293,442 B1
(45) Date of Patent: Sep. 25, 2001

(54) TIMED AEROSOL SPRAY DISPENSER

(76) Inventor: Girard D. Mollayan, 23501 W. Ave. D, Lancaster, CA (US) 93536

( * ) Notice: Subject to any disclaimer, the term of this patent is extended or adjusted under 35 U.S.C. 154(b) by 0 days.

(21) Appl. No.: 09/571,222

(22) Filed: May 16, 2000

(51) Int. Cl.[7] ..... B67D 3/00
(52) U.S. Cl. ..... 222/504
(58) Field of Search ..... 222/70, 642, 647, 222/649, 504, 509

(56) References Cited

U.S. PATENT DOCUMENTS

| | | | | |
|---|---|---|---|---|
| 3,018,056 | * | 1/1962 | Montgomery | 222/647 |
| 3,139,218 | * | 6/1964 | Cairelli | 222/642 |
| 3,214,062 | * | 10/1965 | Mahon | 222/70 |
| 3,732,509 | * | 5/1973 | Florant et al. | 222/70 |
| 3,739,944 | * | 6/1973 | Rogerson | 222/70 |
| 4,483,466 | * | 11/1984 | Gutierrez | 222/647 |
| 5,249,718 | * | 10/1993 | Muderlak | 222/642 |

* cited by examiner

*Primary Examiner*—Philippe Derakshani
*Assistant Examiner*—Thach H. But
(74) *Attorney, Agent, or Firm*—Albert O. Cota

(57) ABSTRACT

A timed spray dispenser for distributing a liquid deodorizer from an aerosol spray can, using a finger actuated spray valve, that incorporates a structural housing (22) with a radial cavity (28) of a size to accommodate the spray can. A lever arm (42) pivots on the housing and encompasses the spray valve on one end. An eccentric cam (56) engages the other end of the lever arm and raises the arm when the cam is rotated with a motor (62). A timer (68) electrically attached to the motor is employed when specific time duration and frequency is required by the dispenser. Height adjustment of the dispenser is achieved to accommodate various sizes of cans by separating the housing from the base (24) using posts (32) that slide into bores (36) in the housing and securing the adjustment using thumb screws (38). A second embodiment provides height adjustment using a fixed height housing and a sliding shelf (74). A third embodiment adds an enclosure (29) that covers the entire dispenser and an optional remote or manually actuated reset switch (84) to operate the dispenser from the switch or from a remote location.

7 Claims, 5 Drawing Sheets

TIMED AEROSOL SPRAY DISPENSER

TECHNICAL FIELD

The present invention pertains generally to spray dispensers and more particularly to a device that automatically depresses a nozzle of an aerosol spray can at predetermined intervals.

BACKGROUND ART

Previously, many types of spray dispensers have been used to provide a means of dispensing a liquid in a pressurized aerosol container. Medicinal atomizing sprays have been developed to dispense a particular amount of medication at a given time. Electromagnetic solenoids have been used to dispense short bursts of atomized sprays, and electric motors and timers have also been used for this purpose.

A search of the prior art did not disclose any patents that read directly on the claims of the instant invention, however the following U.S. patents are considered related:

| U.S. Pat. No. | Inventor | Issue Date |
|---|---|---|
| 5,294,022 | Earle | Mar. 15, 1994 |
| 5,392,768 | Johansson | Feb. 28, 1993 |
| 4,896,832 | Howlett | Jan. 30, 1990 |
| 4,702,400 | Corbett | Oct. 27, 1987 |
| 4,483,466 | Guituerrez | Nov. 20, 1984 |
| 4,427,137 | Dubini | Jan. 24, 1984 |
| 3,974,941 | Mettler | Aug. 7, 1976 |
| 3,968,905 | Pelton | Jul, 13, 1976 |
| 3,814,297 | Warren | Jun. 4, 1974 |

Johansson in U.S. Pat. No. 5,392,768 teaches a portable battery-powered hand-held device for dispensing medication from a aerosol container. A medication cassette has a housing for containing the medication and a body which includes an actuator to depress the canister for release of the medication. The mechanism includes a motor trigger pin and compression springs which permits the motor to release the spray in response to sensed flow, thus satisfying a selected delivery threshold. The body has a flow sensor with a calibrated orifice which converts sensed pressure, due to flow, into a flow rate.

U.S. Pat. No 4,896,832 issued to Howlett is for a dispensing apparatus with a hollow body having trigger means that urge a container body axially towards the end of a housing. A valve stem is depressed by relative movement together with a valve and actuator, thereby dispensing a metered quantity of fluid.

U.S. Pat. No. 4,702,400 of Corbett discloses an aerosol dispensing metering valve for use with a container for pressurized material.

Guituerrez in U.S. Pat. No. 4,483,466 teaches an apparatus for automatically operating the discharge valve of a pressure container that includes an electric motor controlled by a timing device. A motor shaft drives a belt which is connected to a speed reduction unit having a plurality of intermeshing toothed wheels; the last wheel has an eccentric which cooperates with a roller provided on one arm of a pivoted elbow. The arm is spring loaded on one end and the other end presses the nozzle of a container.

U.S. Pat. No. 4,427,137 issued to Dubini discloses an aerosol dispensing metering valve for use with a container for pressurized material.

Mettler discloses in U.S. Pat. No. 3,974,941 a device that discharges short bursts of atomized liquid from an aerosol can. A normally closed piston valve is opened by electromagnetic means. The period between bursts is determined by combined resistor and capacitor circuitry.

U.S. Pat. No. 3,968,905 issued to Pelton is for the timed release of aerosol spray in a can. The contents of the can passes through a sintered plug and an orifice into a measuring chamber. An exit passage is sealed by a spring disk. When the contents enter the chamber, the pressure rises until it overcomes the resistance of the spring disk permitting a concave shaped disk to snap open. When the contents escape, the pressure within the chamber diminished until the disk snaps back into its original shape. The cycle is repeated.

U.S. Pat. No. 3,814,297 issued to Warren discloses a dispenser having a duct with an inlet and an outlet, and a means for receiving an aerosol spray container. The container spray stem towards the stem will activate the spray stem. The device disengages the strut to release the spray stem when the air pressure at the outlet of the duct falls below the air pressure at the inlet of the duct.

For background purposes and as indicative of the art to which the invention is related reference may be made to the remaining cited U.S. Pat. No. 5,294,022 issued to Earle.

DISCLOSURE OF THE INVENTION

Disinfectant and deodorizing sprays are often distributed to the public in containers under pressure, such as aerosol cans, which use a type of gas as a propellant. The gas may be a halocarbon, such as trichlorofluoromethane, an ethane such as tetrafluoroethane, or even a hydrocarbon such as n-butane, all of which quickly dissipate in the atmosphere, leaving only the liquid disinfectant or deodorizer remaining in the form of a mist. The disinfectant and deodorizing sprays in aerosol cans are common and have the ability of both controlling bacteria and fungi along with a limited number of viruses, and deodorizing the area in which they are sprayed.

One of the problems with aerosol sprays is that they require a person to manually spray the area at given times to maintain constant control, particularly in environments where the issue persists over long periods of time. Therefore the primary object of the invention is to provide a device that automatically sprays a disinfectant and/or a deodorizer at a pre-selected intervals.

An important object of the timed aerosol spray dispenser that it may be used for a large number of applications, such as in public rest rooms, hospitals, garbage areas, commercial kitchens, pet areas, recycling bins, etc.

Another object of the invention is that the timed dispenser is designed to accommodate spray cans having various heights.

Still another object of the invention is the ease of changing spray cans, as the user has to only remove a protective cover and place the can in a holder that has been adjusted to the appropriate height. A lever arm will depress a valve at the interval and duration which is either already predetermined or is manually adjusted as required.

Yet another object of the invention is that the dispenser incorporates a housing which is attractive and simple in its design thus permitting the device to be installed or placed on a surface in the area to be treated without being objectionable or distracting from its surroundings.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
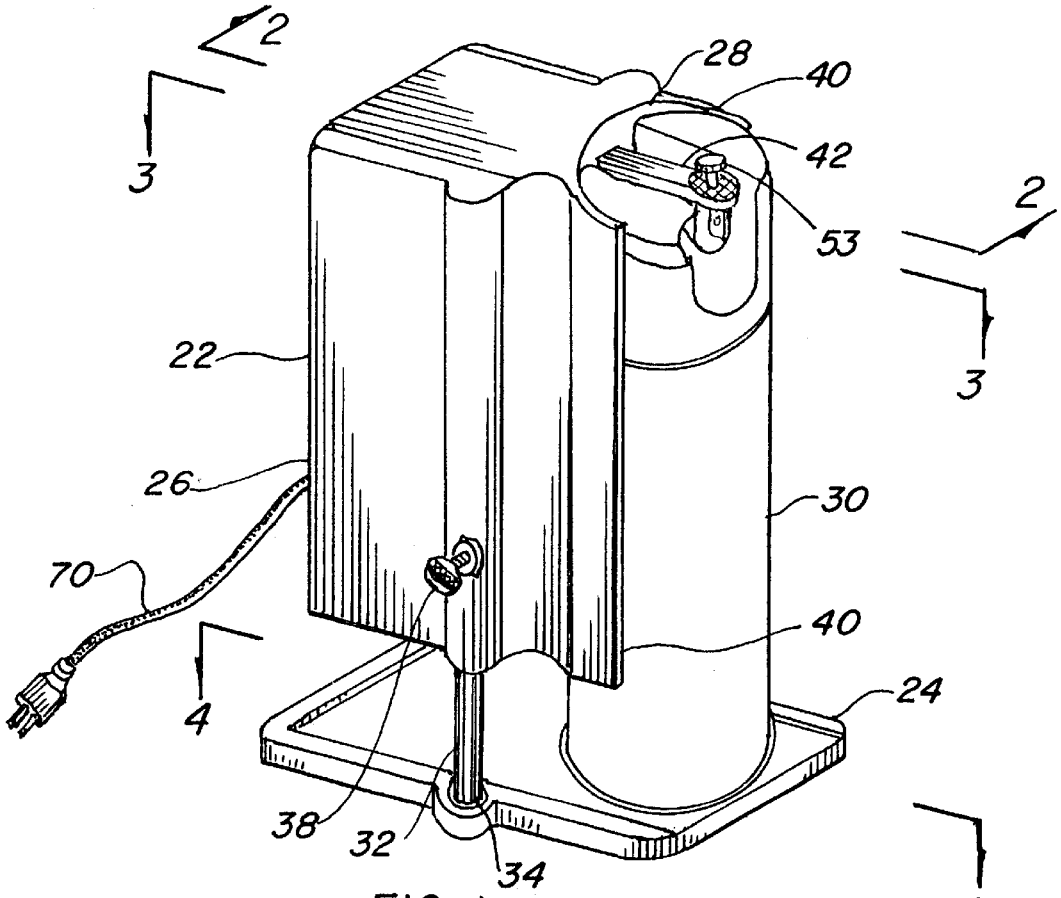
FIG. 1 is a partial isometric view of the preferred embodiment.

The best mode for carrying out the invention is presented in terms of a preferred, a second and a third embodiment, differing only in a height adjusting configuration and enclosure. The preferred embodiment is shown in FIGS. 1 through 17, and is comprised of structural housing 22 defined by a base 24 and a body 26 having a radial cavity 28 integrally formed therein of a size to retain an aerosol spray can 30. The body 26 is connected to the base 24 with a plurality of posts 32, preferably two, which are disposed within sockets 34 integrally formed within the base. The housing 22 is hollow and has a relatively thin wall to protect the internal moving components equipment and to produce a pleasing external appearance. There are bores 36 formed into the housing 22 that slideably receive the posts 32 thereby permitting the housing to easily slide up and down on the posts for height adjustment. As there are different size aerosol spray cans, adjustment of the housing 22 to mate with a particular can height is easily accomplished by simply separating the base 24 from the housing 22 until the proper dimension is achieved. In order to retain the adjustment, a threaded fastener, or the like, is provided within the housing 22 contiguous with each post 32 preferably,in the form of a thumb screw 38 as illustrated in FIG. 1.

It should be noted however, that there are many different methods of retaining the post 32 that are well known in the art, such as spring-loaded posts with notches held in place with detents, compression connections, eccentric cams, etc. that could be easily substituted without affecting the scope of the invention. The housing 22 is formed with a box-like section to enclose the internal moving components and also includes a pair of extending arms 40 that partially encompass the aerosol can 30, as shown best in FIG. 3. These arms 40 are radial and are sized to lightly grip the can so that it will fit snugly without falling out when handled. While protrusions that surround the posts 32 are illustrated in the drawings, the housing 22 may also be rectangular and enclose the posts entirely within its outer boundary. The housing 22 is preferably fabricated using injection molded thermoplastic however, sheet metal construction is also a viable approach. The thermoplastic material described may be any type suitable for the application, such as acetyl, phenolic, polycarbonate, polyethylene, polyurethane, polyester, polypropylene or polystyrene. The posts 32 may be made of metal tubing or a thermoplastic such as fiberglass, carbon fiber or even the same material as the housing.

Figure 2:
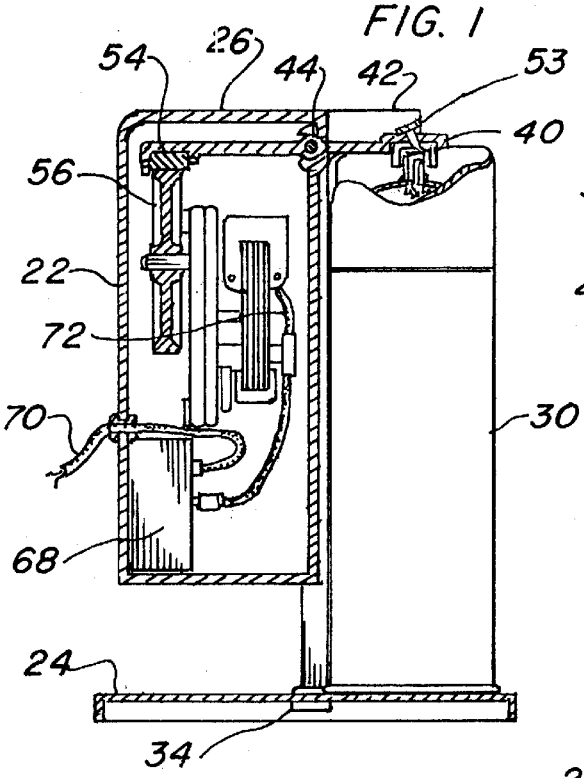
FIG. 2 is a cross sectional view taken along lines 2—2 of FIG. 1 illustrating the internal components including a programmable solid state electronic cycle timer.
Figure 3:
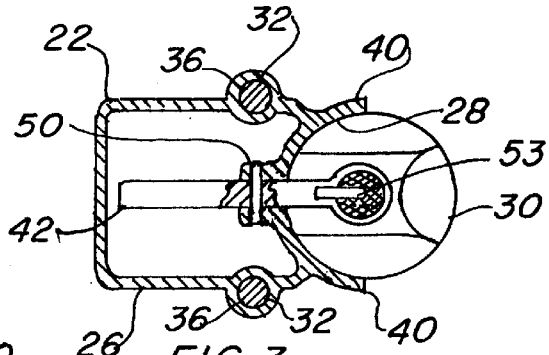
FIG. 3 is a cross sectional view taken along lines 3—3 of FIG. 1.
Figure 4:
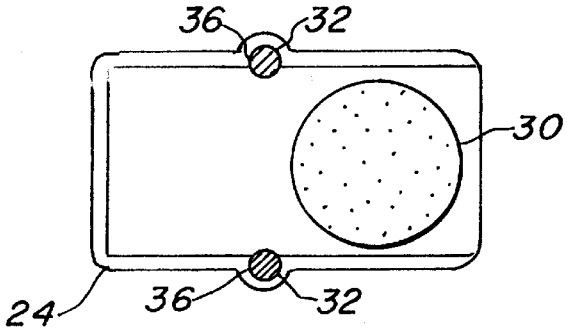
FIG. 4 is a cross sectional view taken along lines 4—4 of FIG. 1.
Figure 5:
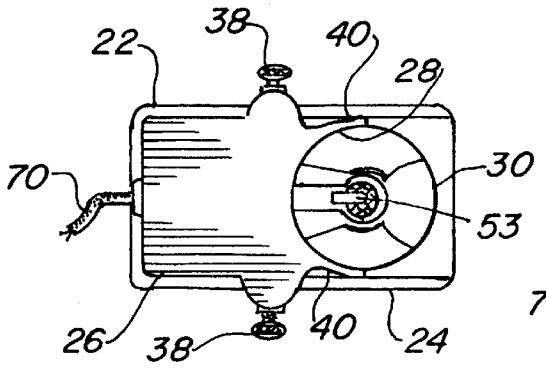
FIG. 5 is a partial top view of the preferred embodiment
Figure 6:
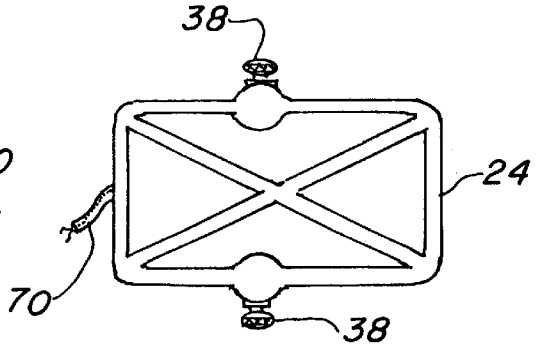
FIG. 6 is a bottom view of the preferred embodiment
Figure 7:
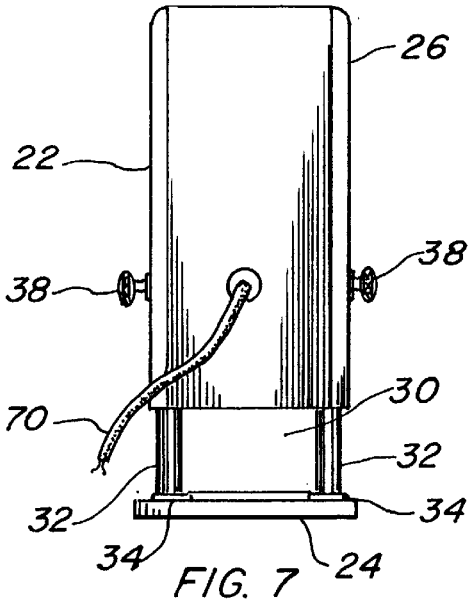
FIG. 7 is a rear view of the preferred embodiment
Figure 8:
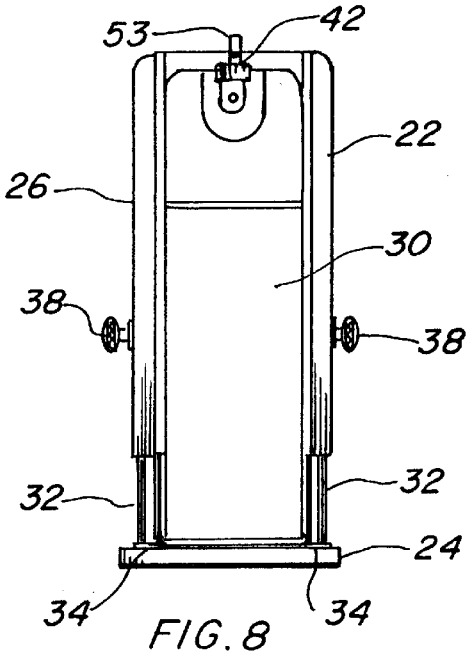
FIG. 8 is a front view of the preferred embodiment
Figure 11:
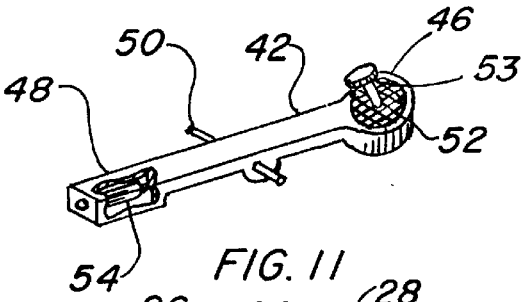
FIG. 11 is a partial isometric view of the lever arm completely removed from the invention for clarity.
Figure 12:
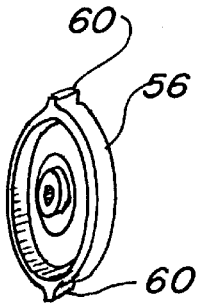
FIG. 12 is a partial isometric view of the cam completely removed from the invention for clarity.

A lever arm 42 is pivotally disposed within the body 22 with a pivot point 44 positioned essentially in the middle of the lever arm. This lever arm 42 has a first end 46 and a second end 48, with the first end 46 enclosing the valve of the spray can 30, thereby holding the can vertically in place within the radial cavity 28 as illustrated in FIG. 2. The lever arm's first end 46 also has a finger push pad 52 that is used to bypass the timed spray by manually depressing the spray valve on the aerosol can 30 that is positioned within the cavity 28 In order to accommodate various sizes of aerosol spray cans a manual adjustment screw 53 is threadably inserted through the pad 52 as shown in FIGS. 1–3, 5, 9, 11, 14, 18, 19, 22, and 23. The adjustment screw 53 is adjusted to apply pressure to the valve just prior to release of spray. This screw 53 is angled from 3 degrees to 15 degrees to compensate for the various configurations of the valves of spray cans. A hinge pin 50 at the pivot point 44 provides diminished friction with the housing 22, as depicted in FIGS. 2, 3 and 11. The lever arm's second end includes friction reducing means in the form of a needle roller bearing 54, as shown in FIG. 2, or any other low friction device, such as an imbedded round ball or even a simple knife edge formed integrally into the arm 42. Optionally the lever arm 42 may include a sliding member 43 or the first end made in two pieces as illustrated in FIG. 23 again to accommodate the various diameters of cans.

An eccentric cam 56 is rotatably positioned within the housing 22 using some type of axle 58 to provide free revolving movement of the cam. The cam 56 is in communication with the second end 48 of the lever arm 42 for raising the arm above the pivot point while conversely lowering the first end 46 to actuate the spray valve on the aerosol can 30. In order to provide the proper duration of spraying the eccentric cam 56 has at least one raised lobe 60 that interfaces with the lever arm 42, thus raising it sufficiently to cause the spraying action. It should be noted that more than one raised lobe 60 may be used according to the rotational speed of the cam and the desired interval. The drawings depict two lobes 60 one on top and the other on the bottom in FIG. 12; further any number may be used according to the application. While a round cam 56 is illustrated, any shape may be used with equal ease; a separate arm that is rotated on the axle 58 or a plurality of arms or the like may also be utilized.

Figure 9:
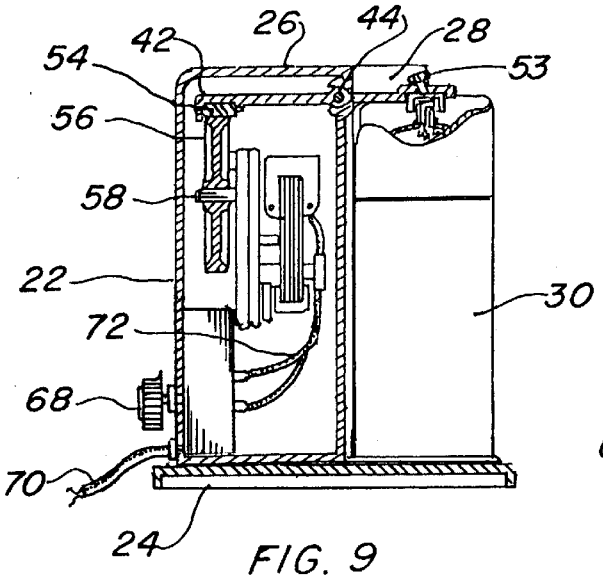
FIG. 9 is an cross sectional view of a variation of the preferred embodiment using a mechanical tripper motor driven cycle timer, and a short aerosol can, the view taken on the centerline of the invention.
Figure 10:
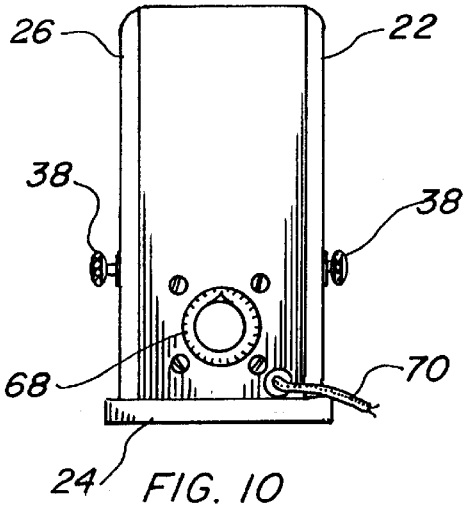
FIG. 10 is a rear view of the same variation as above using a mechanical tripper motor driven cycle timer and a short aerosol can.
Figure 13:
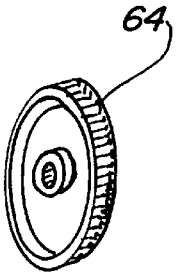
FIG. 13 is a partial isometric view of the pulley completely removed from the invention for clarity.
Figure 14:
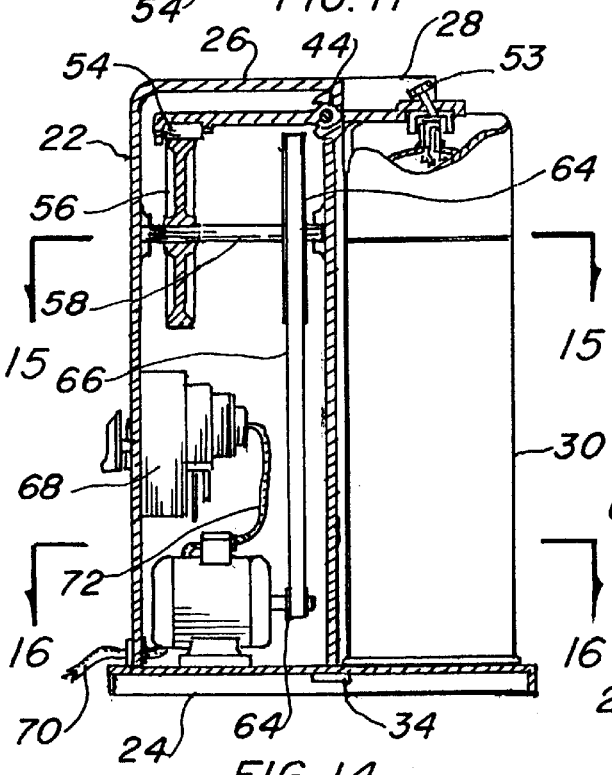
FIG. 14 is an cross sectional view of a variation of the preferred embodiment using a spring wound mechanical timer and a motor with a belt drive taken in cross section on the centerline thereof.
Figure 15:
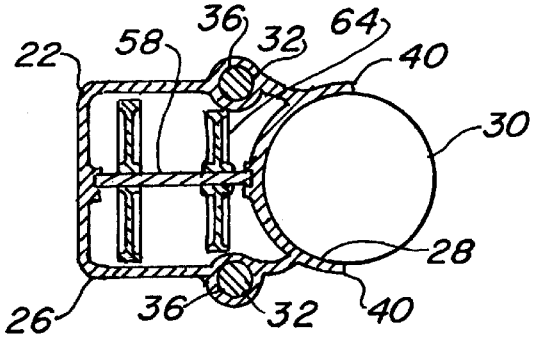
FIG. 15 is a cross sectional view taken along lines 15—15 of FIG. 14.
Figure 16:
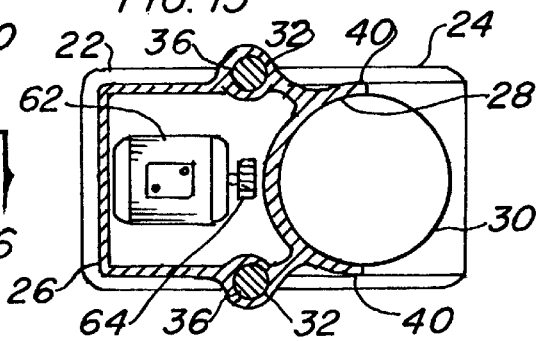
FIG. 16 is a cross sectional view taken along lines 16—16 of FIG. 14.
Figure 17:
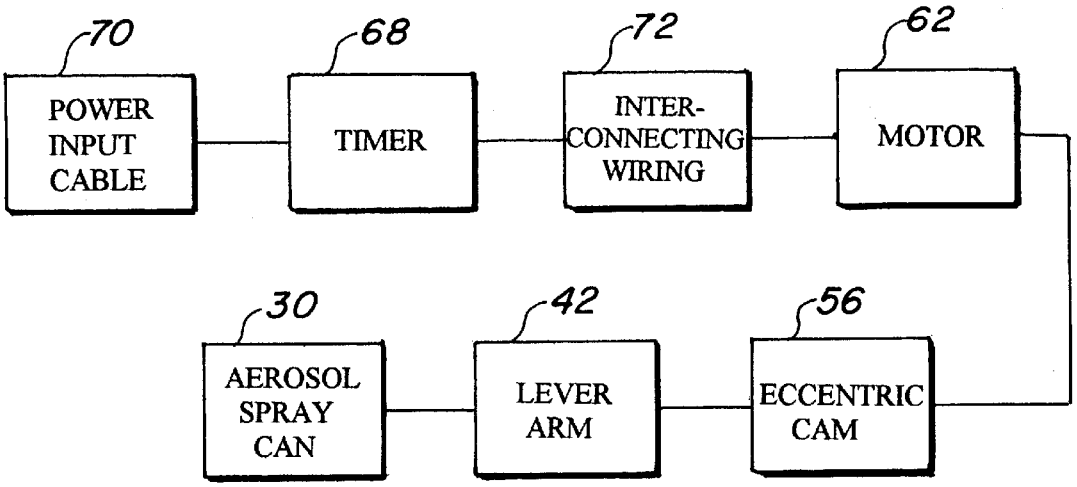
FIG. 17 is a electromechanical schematic of the preferred embodiment.
Figure 18:
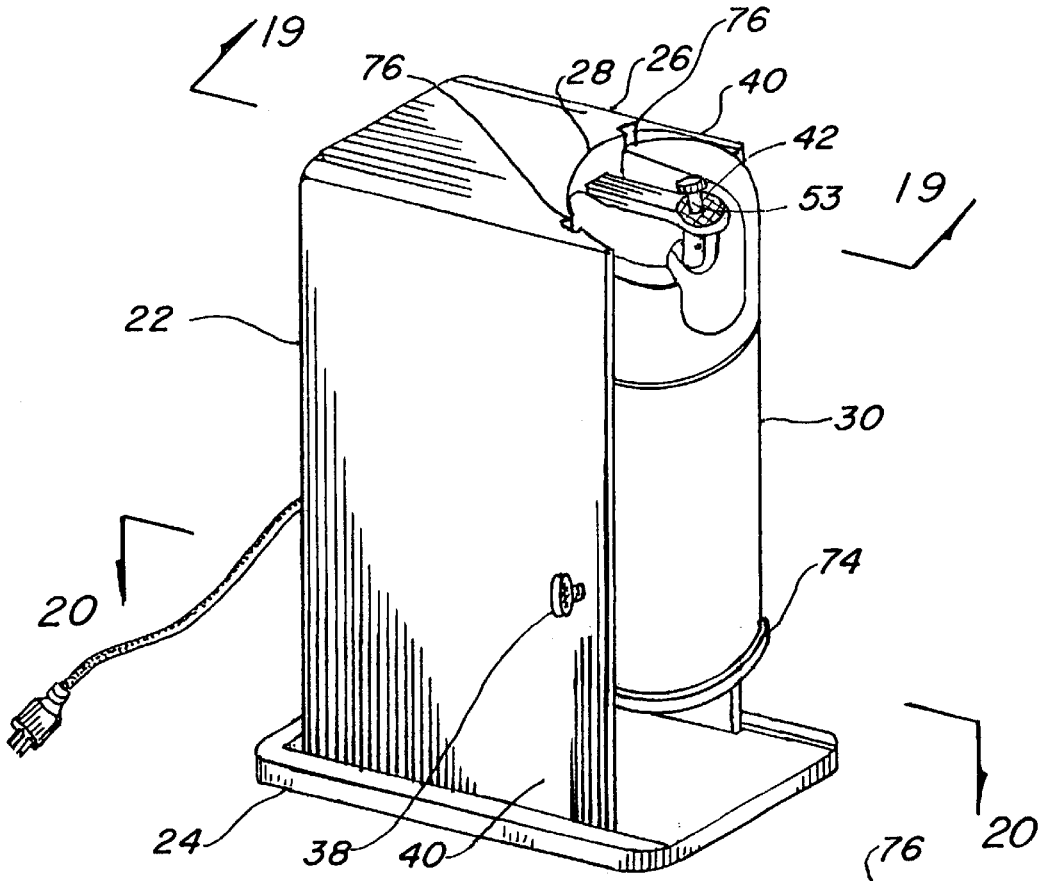
FIG. 18 is a partial isometric view of the second embodiment.
Figure 19:
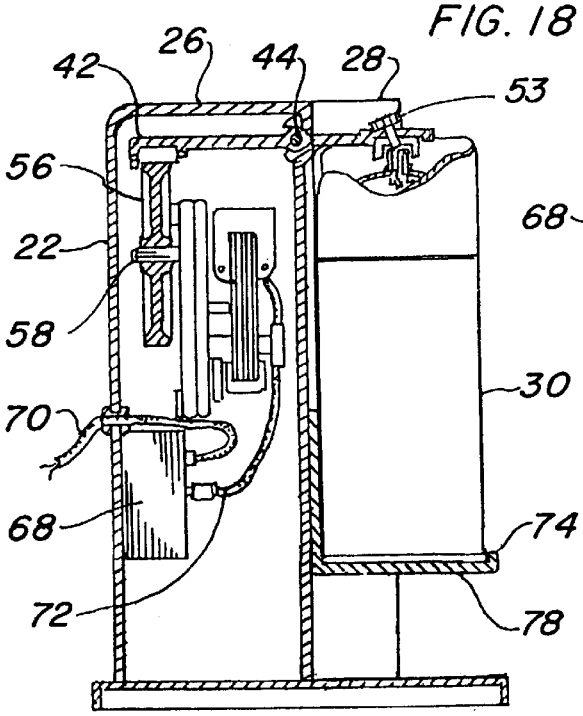
FIG. 19 is a cross sectional view taken along lines 19—19 of FIG. 18 illustrating the internal components including a gearmotor and a programmable solid state electronic cycle timer, with the sliding shelf adjusted to fit a short aerosol can.
Figure 20:
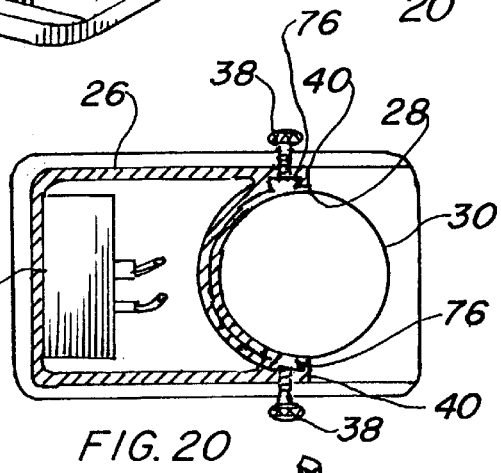
FIG. 20 is a cross sectional view taken along lines 3—3 of FIG. 1.
Figure 21:
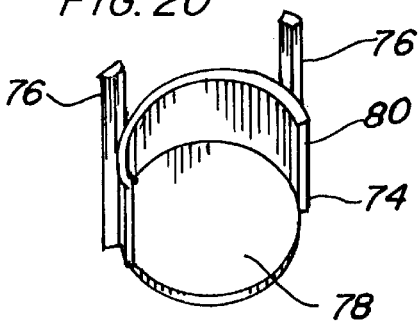
FIG. 21 is a partial isometric view of the sliding shelf completely removed from the invention for clarity.

A motor 62 located within the housing 22 is in communication with the eccentric cam 56 for mechanical rotation of the cam to actuate the spray valve in the aerosol can 30 when the raised lobe 60 engages the lever arm 42. Motors are well known in the art and use electrical energy to cause rotation therefore there are many types and styles available. The preferred motor 62 is a gearmotor type that has built in speed reduction gears and a shaded pole motor, as illustrated in FIGS. 2, 9 and 19, this type of motor omits the need for a separate axle 58, as the eccentric cam 56 may be mounted directly to the shaft of the gearmotor. Another choice for a type of motor is a shaded pole or a universal motor using a cog pulley 64 and belt 66 for the speed reduction. FIG. 14 illustrates this design option using the cog belt 66 and a cog pulley 64 as shown in FIG. 13. With this design the speed of the cam 56 is governed by the ratio of the diameter of the cog pulley 64 on the motor 62, and the diameter of the cog pulley 64 on the axle 58 driving the cam, which may be selected to achieve the optimum time interval.

Timing means are contained within the housing 22. Electrical communication with the motor 62 is utilized, to start and stop the motor operation at predetermined time intervals for repetitive spraying of the deodorizer. The timing means can be as simple as the selection of the motor speed and number of lobes 60 on the cam 56, or the gear ratio of the belt drive system using pulleys 64 and a belt 66. When a more sophisticated control in time intervals is required, the timing means may include a separate timer 68, as illustrated in FIGS. 2, 9, 14 and 19. The timer 68 may be a programmable solid state electronic cycle timer, as shown in FIG. 2 and 19, a mechanical tripper motor driven cycle timer, as depicted in FIG. 9, or a spring wound mechanical timer, as illustrated in FIG. 14. While these conventional timers 68 are described and illustrated, there are a myriad of other electromechanical and electronic devices that would function equally well. Further, the timing may be controlled to accommodate any and all functional utility as desired. A power input cable 70 is required for connection to a power source and interconnecting wiring 72 is necessary to interface between the motor 62 and the timer 68.

A spray can height adjusting means is integral with the housing 22, and is included to accommodate various heights of spray cans. The adjusting means in the preferred embodiment is the plurality of posts 32, that are attached to the base 24, as illustrated in FIGS. 1–8 and 14–16. The body 26 has a plurality of post mating bores 36 with the posts disposed within the bores in a slip-fit manner as described previously. While thumb screws 38 are preferred to lock the posts 32 in position after the adjustment for height has been made, similar devices may also be utilized to grasp the posts 32 and hold them in place.

The second embodiment is pictorially shown in FIGS. 18–21 and differs in that the housing 22 has an integral base 24, and body 26 that has a height necessary to hold the largest conventional aerosol spray can 30. The spray can height adjusting means in this embodiment consists of a sliding shelf 74 that is fitted into the body 26 of the housing 22 in a movable manner using dovetails 76 or the like. Locking means to fasten the shelf 74 in place after height adjustment is accomplished using the same threaded fasteners as in the preferred embodiment in the form of thumb screws 38 positioned appropriately through the housing 22 or the same alternate approaches. The shelf 74 is shown by itself in FIG. 21 and consists of a round horizontal foot 78 and a semi-circular vertical wall 80 with the dovetails 76 elongated to accommodate various sizes of spray cans.

Figure 22:
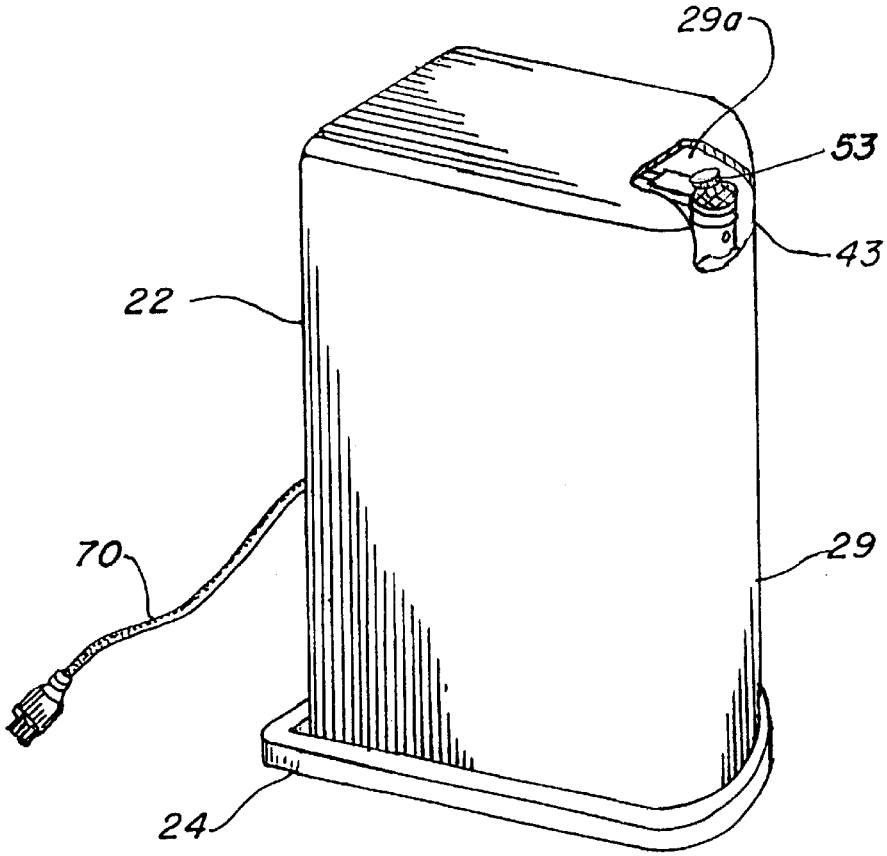
FIG. 22 is a partial isometric view of the third embodiment.
Figure 23:
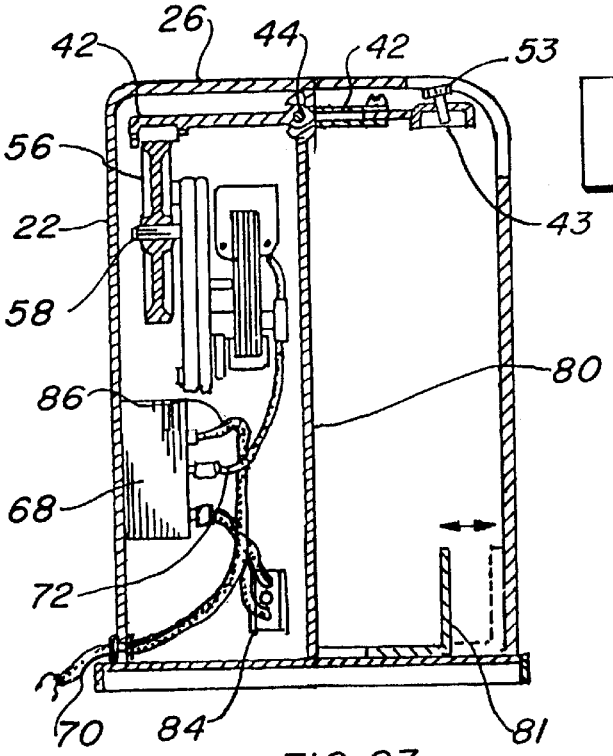
FIG. 23 is an arbitrary cross section view of the third embodiment as illustrated in FIG. 22 taken along the centerline showing the sliding member used for adjustment to accommodate various diameters of spray cans.
Figure 24:
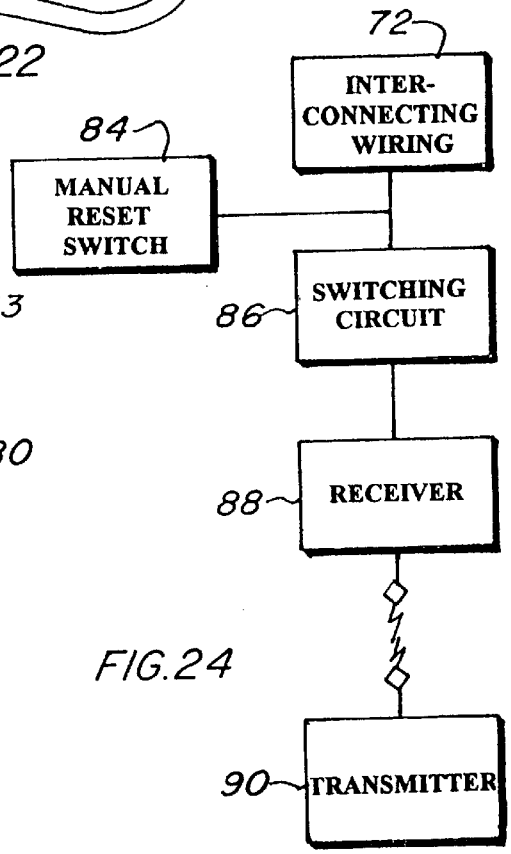
FIG. 24 is a block diagram of the remote control option.

The third embodiment is shown in FIGS. 22 to 24 and differs in that an enclosure 29 is attached over the entire structure after all of the necessary adjustments have been made. This enclosure 29 contains a corner slot 29*a* to allow the spray to exit. A can containment structure 81 consists of a horizontal adjustable shelf similar to the sliding shelf 74 but its size regulation is in the horizontal direction allowing various diameter of cans to be held securely in place.

An option is specifically for the third embodiment but it will function with any of the other embodiments is the addition of a manual reset switch 84 shown in FIG. 23. The switch 84 may be activated manually or by remote control. FIG. 24 shows a block diagram of the system required for operation which includes a receiver 88 mounted on the unit and a remote transmitter 90 that will electrically activate the reset switch 84. 30 Interconnecting wiring 72 and a switching circuit 86 complete the option.

During use both embodiments function in the same manner, with the height adjusted for the aerosol can 30 accomplished by either sliding the body 26 or adjusting the height of the shelf 74 to engage the lever arm's first end 46 with the valve of the can 30, after positioning the can in the cavity 28 of the housing 22. The thumb screws 38 are then tightened and that an adjustable timer 68 is used the setting would be manually made. The timed spray dispenser would then be positioned in an appropriate location and the power input cable 70 attached to the power source for automatic operation.

While the invention has been described in complete detail and pictorially shown in the accompanying drawings, it is not to be limited to such details, since many changes and modifications may be made in the invention without departing from the spirit and scope thereof. Hence, it is described to cover any and all modifications and forms which may come within the language and scope of the appended claims.

What is claimed is:

1. A timed spray dispenser for an aerosol spray can that includes a finger actuated spray valve comprising:

a) a structural housing defined by a base and a body having a radial cavity integrally formed therein of a size to retain the aerosol spray can, b) a lever arm pivotally disposed within the body having a first end and a second end with a pivot point at an essentially middle position, the first end enclosing the valve of the spray can, thereby holding the can vertically in place within the radial cavity, c) an eccentric cam having at least one raised lobe in communication with the second end of the lever arm for raising the arm above the pivot point while lowering the first end to actuate the spray valve.

d) a motor in communication with the eccentric cam for mechanical rotation of the cam to actuate the spray valve when a raised lobe engages the lever arm, e) timing means within the housing body in electrical communication with the motor to start and stop the motor operation at predetermined time intervals for repetitive spray, and f) spray can height adjusting means within the housing to accommodate various heights of spray cans.

2. A timed spray dispenser for an aerosol spray can that includes a finger actuated spray valve comprising:

a) a structural housing defined by a base and a body having a radial cavity integrally formed therein of a size to retain the aerosol spray can, b) a lever arm pivotally disposed within the body having a first end and a second end with a pivot point at an essentially middle position, the first end enclosing the valve of the spray can, thereby holding the can vertically in place within the radial cavity, c) an eccentric cam having at least one raised lobe in communication with the second end of the lever arm for raising the arm above the pivot point while lowering the first end to actuate the spray valve, d) a motor in communication with the eccentric cam for mechanical rotation of the cam to actuate the spray valve when a raised lobe engages the lever arm, e) timing means within the housing body in electrical communication with the motor to start and stop the motor operation at predetermined time intervals for repetitive spray, f) spray can height adjusting means within the housing to accommodate various heights of spray cans, wherein said means comprises a plurality of posts attached to the base and said body having a plurality of post mating bores with the ports disposed within the bores in a slip fit manner.

3. A timed spray dispenser for an aerosol spray can that includes a finger actuated spray valve comprising:

a) a structural housing defined by a base and a body having a radial cavity integrally formed therein of a size to retain the aerosol spray can, b) a lever arm pivotally disposed within the body having a first end and a second end with a pivot point at an essentially middle position, the first end enclosing the valve of the spray can, thereby holding the can vertically in place within the radial cavity, c) an eccentric cam having at least one raised lobe in communication with the second end of the lever arm for raising the arm above the pivot point while lowering the first end to actuate the spray valve, d) a motor in communication with the eccentric cam for mechanical rotation of the cam to actuate the spray valve when a raised lobe engages the lever arm, e) timing means within the housing body in electrical communication with the motor to start and stop the motor operation at predetermined time intervals for repetitive spray, and f) spray can height adjusting means within the housing to accommodate various heights of spray cans, wherein said means comprises a sliding shelf fitted into the housing body in a movable manner and locking means to fasten the shelf in place after height adjustment.

4. The timed spray dispenser as recited in claim 3 wherein said sliding shelf further comprising a round horizontal foot and a semicircular vertical wall.

5. A timed spray dispenser for an aerosol spray can that includes a finger actuated spray valve comprising:

a) a structural housing defined by a base and a body having a radial cavity integrally formed therein of a size to retain the aerosol spray can, b) a lever arm pivotally disposed within the body having a first end and a second end with a pivot point at an essentially middle position, the first end enclosing the valve of the spray can, thereby holding the can vertically in place within the radial cavity, c) an eccentric cam having at least one raised lobe in communication with the second end of the lever arm for raising the arm above the pivot point while lowering the first end to actuate the spray valve, d) a motor in communication with the eccentric cam for mechanical rotation of the cam to actuate the spray valve when a raised lobe engages the lever arm, e) timing means within the housing body in electrical communication with the motor to start and stop the motor operation at predetermined time intervals for repetitive spray, f) spray can height adjusting means within the housing to accommodate various heights of spray cans, and g) a can containment structure defined by a horizontal adjustable shelf permitting regulation in a horizontal direction to accommodate various diameters of cans.

6. A timed spray dispenser for an aerosol spray can that includes a finger actuated spray valve comprising:

a) a structural housing defined by a base and a body having a radial cavity integrally formed therein of a size to retain the aerosol spray can, b) a lever arm pivotally disposed within the body having a first end and a second end with a pivot point at an essentially middle position, the first end enclosing the valve of the spray can, thereby holding the can vertically in place within the radial cavity, c) an eccentric cam having at least one raised lobe in communication with the second end of the lever arm for raising the arm above the pivot point while lowering the first end to actuate the spray valve, d) a motor in communication with the eccentric cam for mechanical rotation of the cam to actuate the spray valve when a raised lobe engages the lever arm, e) timing means within the housing body in electrical communication with the motor to start and stop the motor operation at predetermined time intervals for repetitive spray, f) a reset switch which can be activated manually or by a remote control which includes a receiver mounted on the structural housing, a remote transmitter which electrically activates the reset switch, a switching circuit and interconnecting wiring, and g) spray can height adjusting means within the housing to accommodate various heights of spray cans.

7. A timed spray dispenser for a deodorizing aerosol spray can that has a finger actuated spray valve, the dispenser comprising:

a height adjustable housing having an integral radial cavity sized to retain an aerosol spray can, a lever aim pivotally disposed within the housing with one end enclosing the valve of the spray can, holding the can vertically in place within the radial cavity, a cam in communication with the lever arm to actuate the spray valve, rotation means revolving the cam for actuating the spray valve when the cam engages the lever arm, and timing means in electrical communication with the rotation means to start and stop repetitive spraying of the deodorizer.

* * * * *